US009713838B2

(12) United States Patent
Weber et al.

(10) Patent No.: US 9,713,838 B2
(45) Date of Patent: Jul. 25, 2017

(54) STATIC CORE TIE RODS

(71) Applicant: General Electric Company, Schenectady, NY (US)

(72) Inventors: David Wayne Weber, Simpsonville, SC (US); Dustin Michael Earnhardt, Greenville, SC (US); Michelle Jessica Rogers, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1108 days.

(21) Appl. No.: 13/893,508

(22) Filed: May 14, 2013

(65) Prior Publication Data

US 2014/0341724 A1 Nov. 20, 2014

(51) Int. Cl.

| | |
|---|---|
| ***B22C 21/14*** | (2006.01) |
| ***F01D 5/18*** | (2006.01) |
| ***F01D 25/12*** | (2006.01) |
| ***B22C 9/10*** | (2006.01) |

(52) U.S. Cl.

CPC ..... *B22C 21/14* (2013.01); *B22C 9/108* (2013.01); *F01D 5/187* (2013.01); *F01D 25/12* (2013.01); *F05D 2230/21* (2013.01); *Y10T 428/12361* (2015.01); *Y10T 428/24273* (2015.01)

(58) Field of Classification Search

CPC .. B22C 9/108; B22C 9/10; B22C 9/04; B22C 19/00; B22C 21/14; F01D 5/187; F01D 25/12; F05D 2230/21; Y10T 428/12361; Y10T 428/24273

USPC ..... 164/397, 398, 399, 400, 369, 370

See application file for complete search history.

(56) References Cited

U.S. PATENT DOCUMENTS

| | | | | |
|---|---|---|---|---|
| 1,712,230 A * | 5/1929 | Greif | B22C 21/14 164/398 |
| 2,069,374 A | 2/1937 | Lagomarsino | |
| 3,404,726 A * | 10/1968 | Wittke | B22C 21/14 164/107 |
| 3,662,566 A | 5/1972 | Brand | |
| 3,760,874 A | 9/1973 | Boskovic | |
| 4,596,281 A * | 6/1986 | Bishop | B22C 9/10 164/122.1 |
| 4,637,449 A | 1/1987 | Mills et al. | |
| 5,232,343 A | 8/1993 | Butts | |
| 5,291,654 A | 3/1994 | Judd et al. | |
| 5,623,985 A * | 4/1997 | Wheaton | B22C 9/00 164/122.1 |

(Continued)

OTHER PUBLICATIONS

Office Action for U.S. Appl. No. 13/893,520, dated Jun. 5, 2015, 14 pages.

(Continued)

*Primary Examiner* — Dwayne J White
*Assistant Examiner* — Adam W Brown
(74) *Attorney, Agent, or Firm* — Ernest G. Cusick; Hoffman Warnick LLC

(57) ABSTRACT

A core tie having a varying cross sectional diameter, a component including such a core tie, and a method of casting a hot gas path component for a turbomachine are provided herein. In an embodiment, the core tie includes a tie member having an axial length; and a cross sectional diameter which varies along the axial length of the tie member. A variation in the cross sectional diameter of the tie member positively secures a position of the core tie relative to the core.

20 Claims, 9 Drawing Sheets

(56) References Cited

U.S. PATENT DOCUMENTS

| | | | | |
|---|---|---|---|---|
| 5,947,181 | A * | 9/1999 | Davis | B22C 9/106 164/131 |
| 5,950,705 | A * | 9/1999 | Huang | B22C 9/04 164/122.1 |
| 5,957,657 | A | 9/1999 | Akita et al. | |
| 6,413,041 | B1 | 7/2002 | Sedillo | |
| 6,454,156 | B1 | 9/2002 | Taras, Jr. et al. | |
| 6,533,030 | B2 | 3/2003 | Mitrovic et al. | |
| 6,557,621 | B1 | 5/2003 | Dierksmeier et al. | |
| 6,896,036 | B2 * | 5/2005 | Schneiders | B22C 21/14 164/137 |
| 7,647,945 | B2 | 1/2010 | Finkel | |
| 8,087,565 | B2 | 1/2012 | Kottlingam et al. | |
| 2010/0158701 | A1 | 6/2010 | Khanin et al. | |
| 2011/0058957 | A1 | 3/2011 | Von Arx et al. | |
| 2012/0328451 | A1 | 12/2012 | Lomas et al. | |

OTHER PUBLICATIONS

Hook, Notice of Allowance and Fee(s) Due for U.S. Appl. No. 13/893,520, dated Nov. 20, 2015, 5 pages.

* cited by examiner

STATIC CORE TIE RODS

BACKGROUND OF THE INVENTION

The disclosure relates generally to components having cooling passages cast therein, for high temperature environment use in turbomachines. More particularly, the disclosure relates to a static core tie rod for securing the position of a core during the casting operation and plugging the core tie hole in the wall of the cooling passageway of the component.

Components in turbomachines such as gas turbines typically operate in high temperature environments. In order to efficiently cool components in the hot gas path, such as nozzles and buckets, cooling passageways may be cast into the bodies of the components during fabrication. These cooling passageways allow a fluid to circulate through the cooling passageways, carrying heat away from the component.

In a casting process used to manufacture components having cooling passageways therein, cores made of, e.g., ceramic, may be positioned inside a mold. Small rods called core ties may be embedded in the cores to provide rigidity to the core structure and positively locate the cores in the three-dimensional space within the mold, with respect to the mold, to other cores, and to other legs of the same core. The core ties may be made of a variety of materials including, e.g., ceramic materials, alumina, quartz, or metal alloys.

After casting, the cores and the core ties are typically leached out of the body of the component, leaving behind cooling passageways where the cores had been. Due in part to differences in material composition, core ties may be more difficult and more expensive to leach out than the ceramic cores. In particular, additional leaching cycles and different/higher temperatures may be required in order to remove the core ties. When the core ties are removed, holes remain in the walls of the cooling passageways where the core ties had been. These holes in the cooling passageway walls require additional processing to be sealed by, e.g., welding, brazing, threading, or other means, such as inserting a plug into or over the hole.

BRIEF DESCRIPTION OF THE INVENTION

A core tie having a cross sectional diameter which varies along an axial length thereof, a component including such a core tie, and a method of casting a hot gas path component for a turbomachine are provided herein.

A first aspect of the disclosure provides a core tie for supporting a core during a casting process, the core tie comprising: a tie member having an axial length, and a cross sectional diameter which varies along the axial length of the tie member.

A second aspect of the disclosure provides a component comprising: a body; a first cooling passageway disposed within the body, the first cooling passageway including a first hole therein; and a core tie disposed in the first hole, such that the core tie occludes the first hole. The core tie comprises a tie member having an axial length; and a cross sectional diameter which varies along the axial length of the tie member.

A third aspect of the disclosure provides a method of casting a hot gas path component for a turbomachine, the method comprising: coating a wax pattern for the hot gas path component with a ceramic material, wherein the wax pattern includes a ceramic core inside the wax, wherein the ceramic core is held in place by at least one core tie. The core tie comprises a tie member having an axial length, and a cross sectional diameter which varies along the axial length of the tie member. The method further comprises removing the wax from the ceramic material to form a ceramic shell; filling the ceramic shell with a metal; and removing the shell, leaving the core tie in place.

These and other aspects, advantages and salient features of the invention will become apparent from the following detailed description, which, when taken in conjunction with the annexed drawings, where like parts are designated by like reference characters throughout the drawings, disclose embodiments of the invention.

Figure 1:
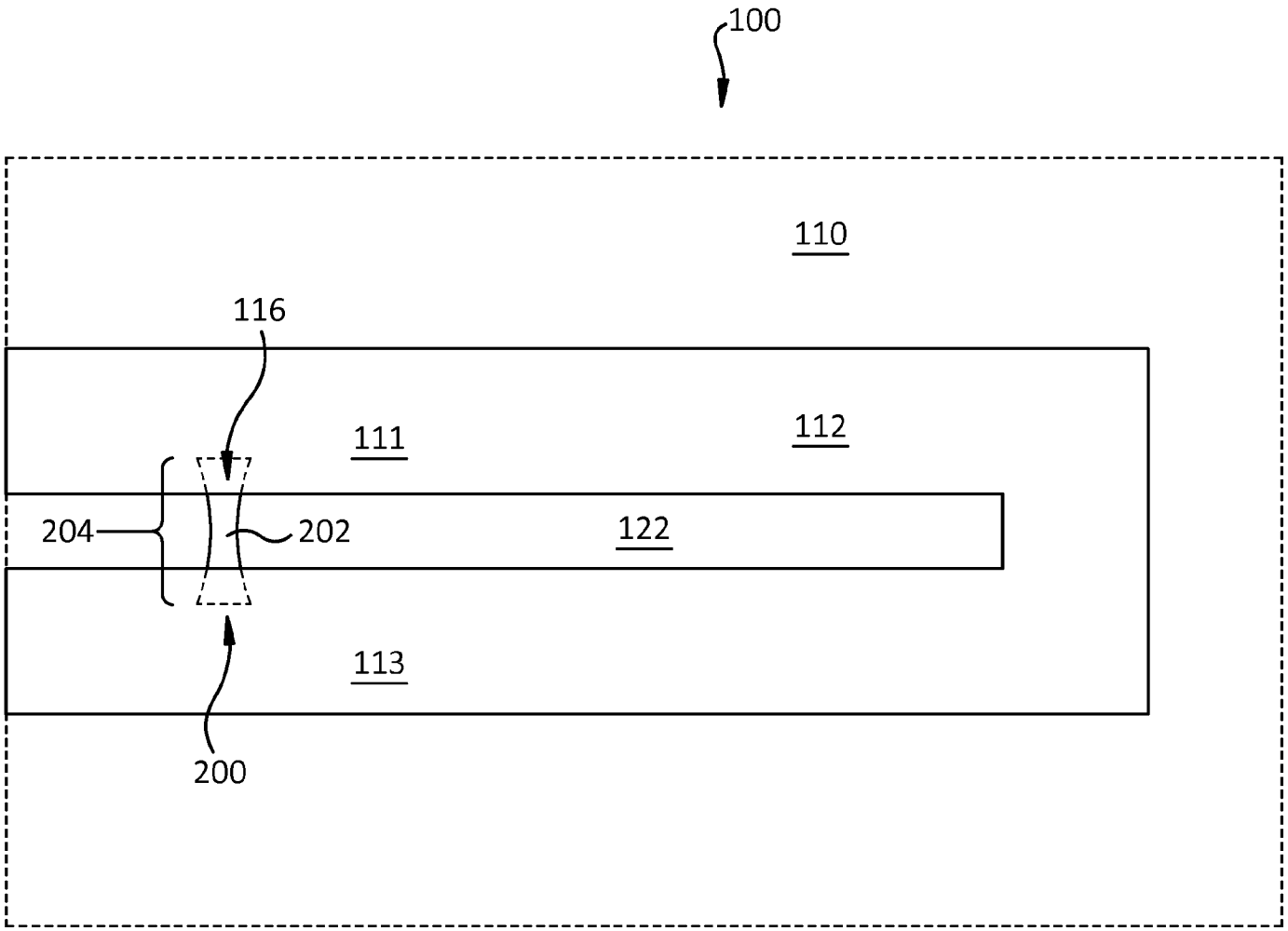
FIG. 1 shows a cross sectional view of a portion of a component including a core tie according to an embodiment of the disclosure.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

At least one embodiment of the present invention is described below in reference to its application in connection with the operation of turbomachine. Although embodiments of the invention are illustrated relative to a turbomachine in the form of a gas turbine, it is understood that the teachings are equally applicable to other types of turbomachines having components with cooling passageways disposed therein. Further, at least one embodiment of the present invention is described below in reference to a nominal size and including a set of nominal dimensions. However, it should be apparent to those skilled in the art that the present invention is likewise applicable to any suitable turbomachine. Further, it should be apparent to those skilled in the art that the present invention is likewise applicable to various scales of the nominal size and/or nominal dimensions.

As indicated above, aspects of the invention depicted in FIGS. 1-8 provide a core tie 200 and a component 100 that includes a core tie 200. Additionally, FIG. 9 provides a flow chart for a method of casting component 100 including core tie 200.

With reference to FIG. 1, a partial view of component 100 is shown. Component 100 may be any type of component fabricated with cooling passageways disposed therein, as is known in the art. In particular, component 100 may be a hot gas path component such as, e.g., a nozzle, a shroud, or a bucket for use in a gas turbine.

Component 100 includes a body 110 with at least one cooling passageway 120 (FIG. 3) disposed within body 110. In various embodiments, cooling passageway 120 may pass through body 110 in any of a number of arrangements such as, e.g., a serpentine cooling passageway. The embodiments shown in FIGS. 3-7 depict a serpentine cooling passageway 120 having a first leg 121 and a second leg 123, but any arrangement of cooling passageways 120 may be used in various embodiments.

Figure 2:
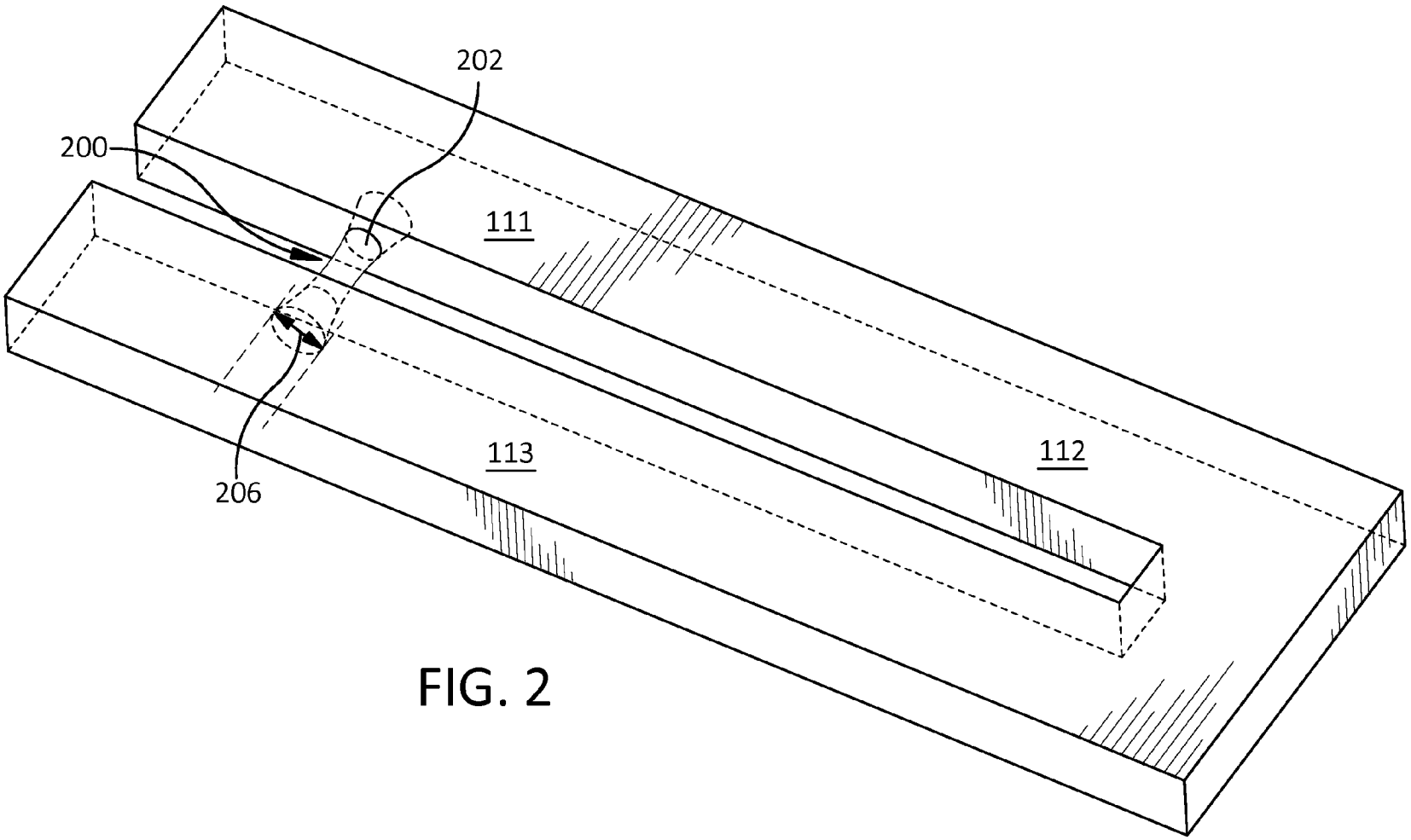
FIG. 2 shows a perspective view of a portion of a component including a core tie according to an embodiment of the disclosure.
Figure 3:
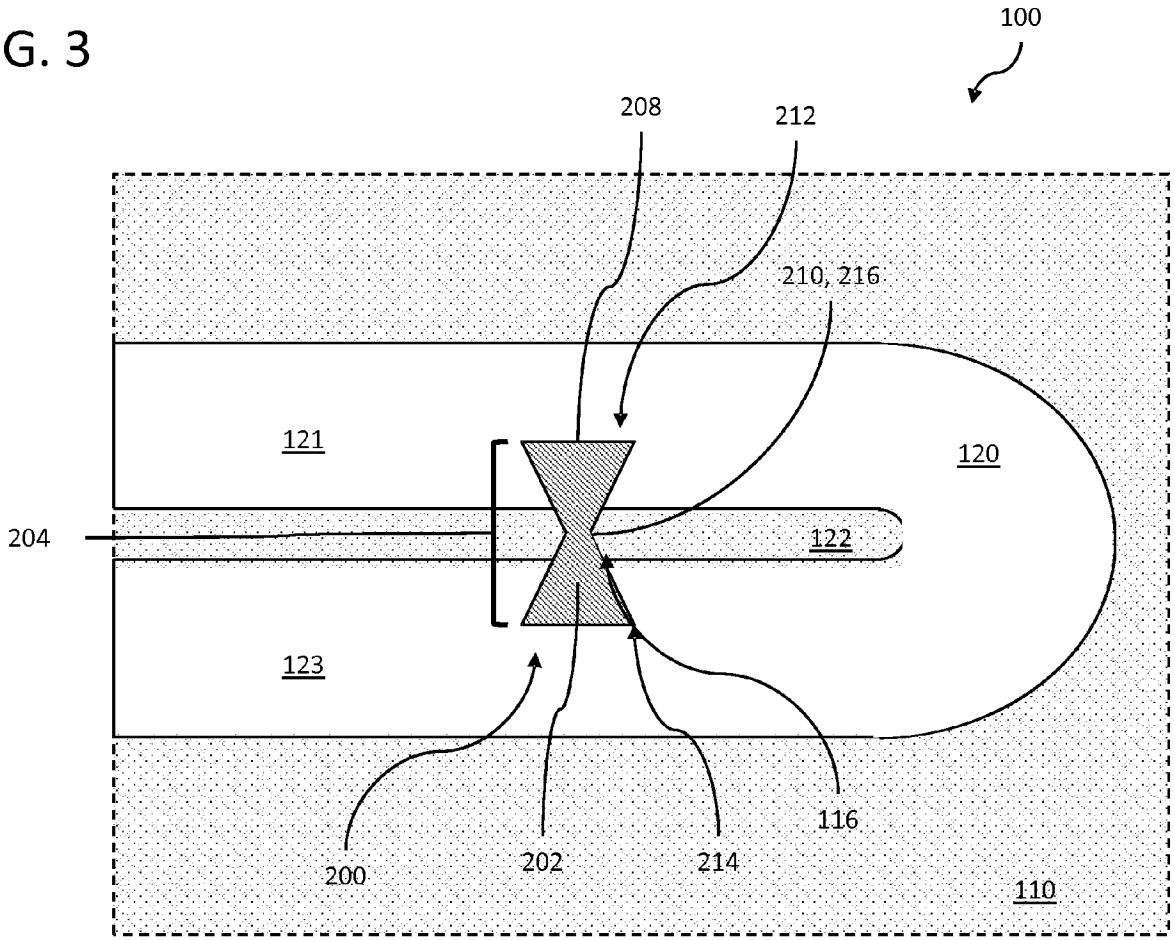
FIGS. 3-7 show cross sectional views of a portion of a component according to embodiments of the disclosure.

Referring back to FIGS. 1-2, the hollow cooling passageways 120 shown in FIG. 3 may be cast in component 100 by providing a core 112 made of, e.g., ceramic, within the component mold (not shown). The core(s) 112 may be held in position within the mold by one or a plurality of core ties 200. Core ties 200 may extend, for example, from core 112 to an inner surface of the mold, from one core 112 to another core, or from one leg 111 of core 112 to another leg 113 of core 112 (FIGS. 1-2). Core ties 200 provide rigidity to core 112, and aid in positively locating core(s) 112 within the three dimensional space of an empty mold.

Molten metal is then poured into the mold having core 112 and core ties 200 disposed therein. The presence of core 112 and core ties 200 prevents the molten metal from flowing into the regions of the mold where the cores 112 and core ties 200 are located. In various embodiments, core ties 200 may be made of any of a variety of materials including but not limited to any ceramic material, alumina, quartz, in particular, silica-based quartz, metals, metal alloys, or tungsten.

Figure 4:
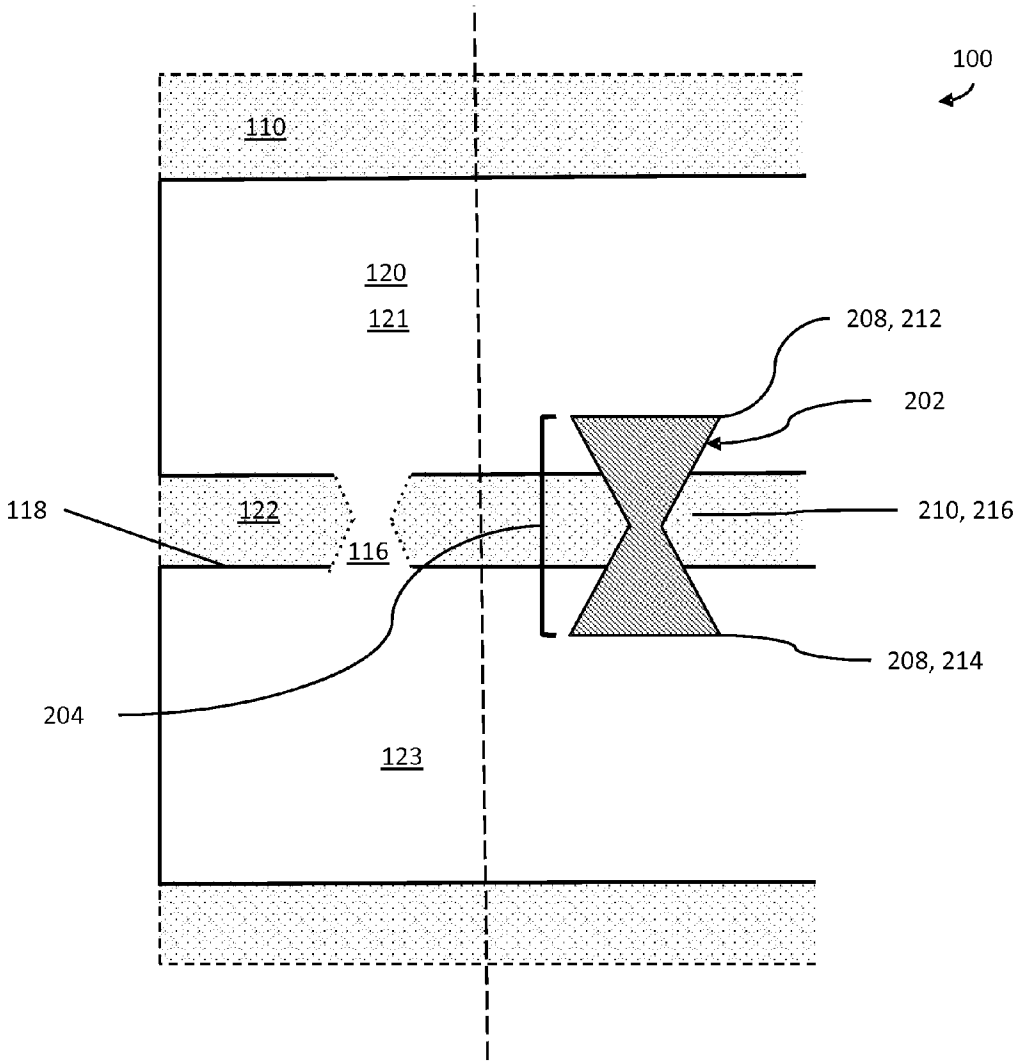

After the metal solidifies to form body 110 (FIGS. 1, 3), the cores 112 (FIGS. 1-2) may be removed, e.g., by leaching out the material forming core 112, as shown in FIGS. 3-8. This results in the formation of voids within the component body 110 where core 112 had been. These voids form hollow cooling passageways 120 (FIGS. 3-8). Core ties 200 may also be removed from body 110 by, e.g., leaching processes. As shown in FIG. 4, when cores 112 (FIG. 2, not shown in FIG. 4) and core ties 200 (FIGS. 3-4) are removed, the resulting cooling passages 120 have holes 116 in walls 118 of cooling passageways 120 where core ties 200 had been, as shown on the left side of FIG. 4. If left unsealed, holes 116 may result in leakage of cooling fluid during use of component 100, and may result in short-circuiting the cooling flow through component 100. In the embodiment of FIG. 4, such leakage may occur between first leg 121 and second leg 123 of cooling passageway 120.

With reference to FIGS. 3-8, in accordance with various embodiments of the disclosure, each core tie 200 includes a tie member 202 having an axial length 204. In an embodiment, shown in FIG. 2, a cross section of tie member 202 is substantially circular, however other embodiments may be used in which a cross section of tie member 202 is ovoid, rectangular, or has any other polygonal shape. Tie member 202 has a cross sectional diameter 206 (FIG. 2) which varies along the axial length 204 of tie member 202. At one or more points along the axial length 204 of tie member 202, cross sectional diameter 206 is greater than a diameter of hole 116. The geometry of core tie 200, specifically these variations in the cross sectional diameters along axial length 204 (FIG. 1) of tie member 202, positively lock the core tie 200 in place in holes 116 and in core body 112 (FIG. 2). This can be accomplished through a variety of different shapes and dimensions discussed further below.

As shown in FIGS. 1-4, in one embodiment, tie member 202 includes a first cross sectional diameter 208 at each of a first end 212 and a second end 214 of tie member 202, and a second cross sectional diameter 210 at a point 216 approximately midway along the axial length 204 of the tie member 202. In these embodiments, the second cross sectional diameter 210 is smaller than the first cross sectional diameter 208. In one embodiment, this may result in a substantially hourglass shaped tie member 202. Additionally, first cross sectional diameter 208 at each of first end 212 and second end 214 is greater than the diameter of hole 116 (FIG. 4). Because first end 212 and second end 214, each having first cross sectional diameter 208, are each disposed on opposite sides of wall 118, core tie 200 cannot slip or slide out of hole 116.

In the particular embodiment shown in, e.g., FIGS. 3-4, a first leg 121 and a second leg 123 of cooling passageway 120 are disposed substantially alongside one another, with a metal ligament 122 disposed therebetween. First leg 121 and second leg 123 have a hole 116 (FIG. 4), disposed such that legs 121, 123 are placed in fluid communication with one another. Core tie 200 passes through the hole 116 in wall 118 in each of first and second legs 121, 123. Core tie 200 is locked in place by the relationship between the first cross sectional diameter 208 at each of first and second ends 212, 214, and the diameter of holes 116. Specifically, core tie 200 cannot move toward first leg 121 because first cross sectional diameter 208 at second end 214 cannot pass hole 116 in wall 118 of second leg 123, and core tie 200 cannot move toward second leg 123 because first cross sectional diameter 208 at first end 212 cannot pass hole 116 in wall 118 of first leg 121.

In various embodiments, the outer surfaces of tie member 202 may be substantially arcuate, or concave, as shown in FIGS. 1-2, or may be substantially angled, as shown in FIGS. 3-4. In this embodiment, tie member 202 may have a shape similar to that of a pair of inverted cones coupled at their respective apexes. Some combination of the arcuate and angled sides is also possible.

Figure 5:
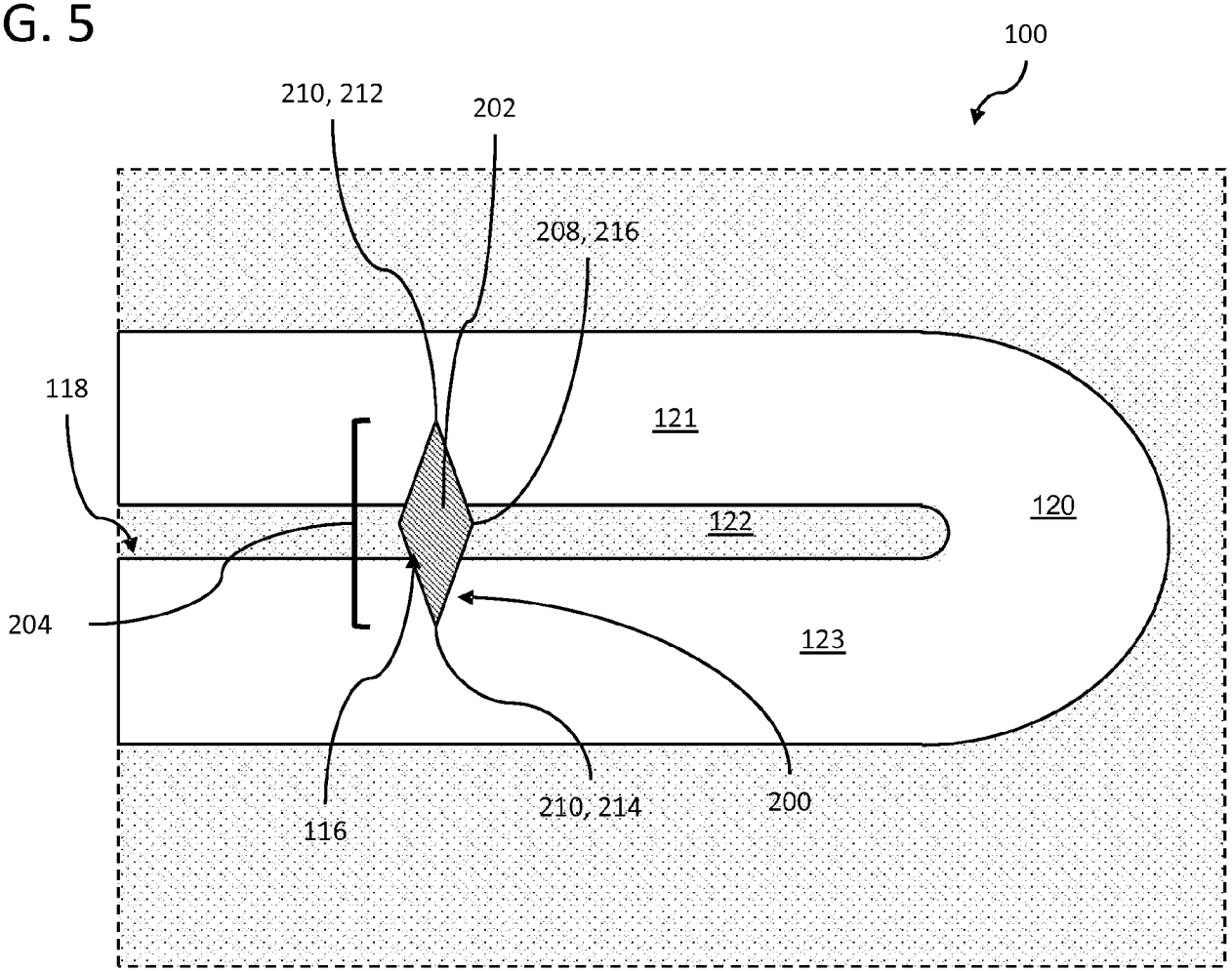
Figure 6:
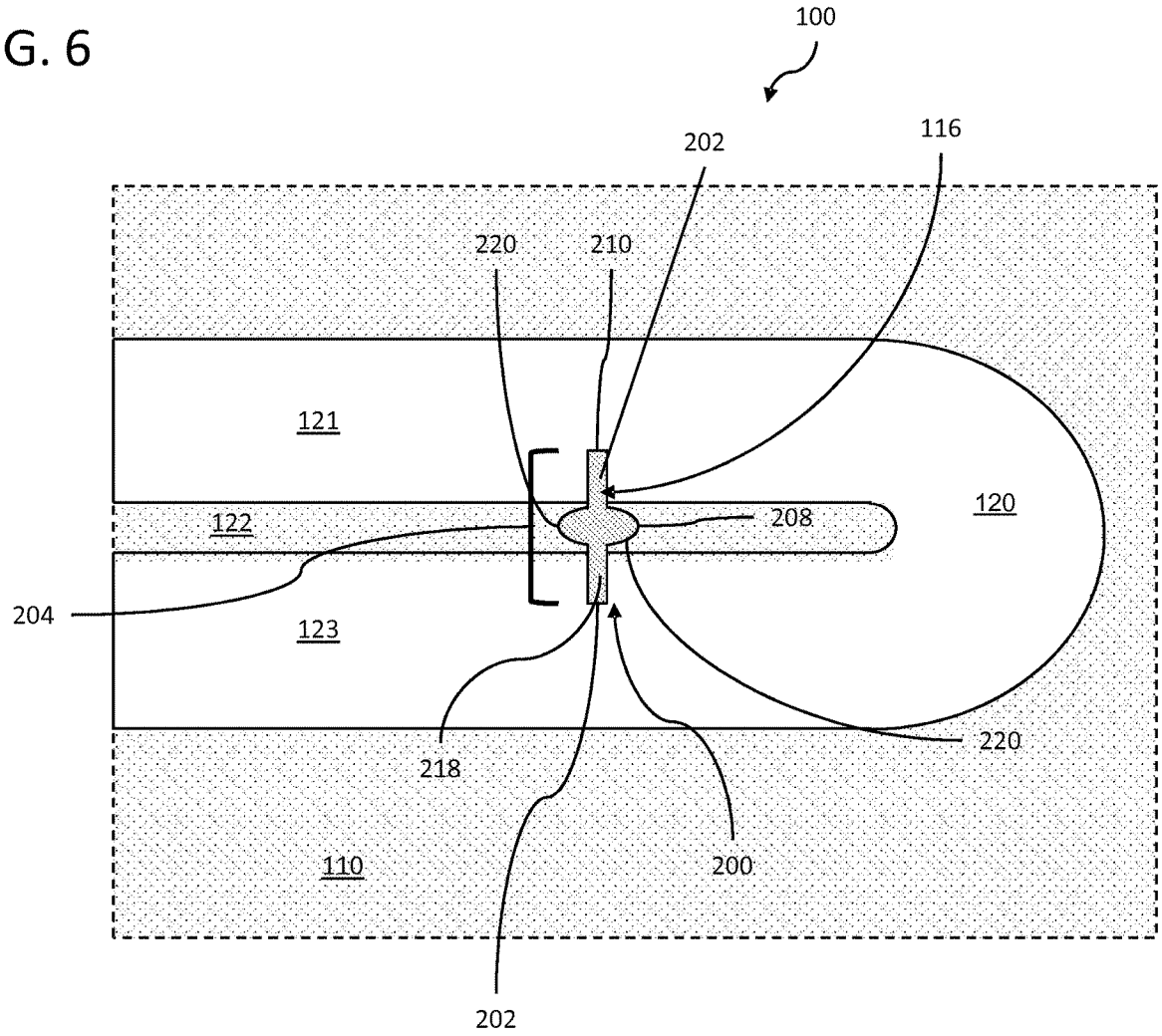

As shown in FIGS. 5-6, in other embodiments, tie member 202 includes a first cross sectional diameter 208 at a point approximately midway along the axial length 204 of tie member 202, and a second cross sectional diameter 210 at each of a first end 212 and a second end 214 of the tie member 202. As described above, first cross sectional diameter 208 is greater than the second cross sectional diameter 210, and is also greater than the diameter of hole 116.

As shown in FIGS. 5-6, a first leg 121 and a second leg 123 of cooling passageway 120 are disposed substantially alongside one another, with a metal ligament 122 disposed therebetween. First leg 121 and second leg 123 each have a hole 116, arranged such that the holes 116 in the respective legs are aligned, and core tie 200 passes through hole 116 in wall 118 in each of first and second legs 121, 123. Core tie 200 is locked in place by the relationship between the first cross sectional diameter 208 at approximate midpoint 216, and the diameter of holes 116. Specifically, core tie 200 cannot leave one of legs 121, 123 to slide into the other, because the approximate midpoint 216, having first cross sectional diameter 208, cannot pass through hole 116.

As in the embodiment of FIG. 5, core tie 200 may be shaped substantially like a pair of cones with abutting bases, with the bases meeting at approximate midpoint 216, and the respective apexes being located at first end 212 and second end 214. The diameter of core tie 200 may thus increase gradually from each of first end 212 and second end 214 toward approximate midpoint 216. In some embodiments, the cross sectional diamater of core tie 200 may exceed the diameter of hole 116 only at the approximate midpoint 216 along the axial length of tie member 202. In other embodiments, as depicted in FIG. 5, the cross sectional diameter of core tie 200 may exceed the diameter of hole 116 for a longer portion of axial length 204 of tie member 202. This may result in a more snug or secure fit of core tie 200 in holes 116.

FIG. 6 depicts another embodiment, in which core tie 200 functions similarly to the embodiment of FIG. 5. In this embodiment, tie member 202 includes a rod member 218 with a bead 220 disposed on rod member 218 approximately midway along the axial length of rod member 218. Bead 220 may be, for example, substantially spherical to ovoid in shape, and may have a first cross sectional diameter 208 that exceeds the diameters of holes 116. Rod member 218 may have a second cross sectional diamater 210 that is smaller than first cross sectional diameter 208. As with previous embodiments, the transitions between segments of tie member 202, e.g., rod member 218 and bead 220, may be as gradual or as sharp as desired for a given application.

Figure 7:
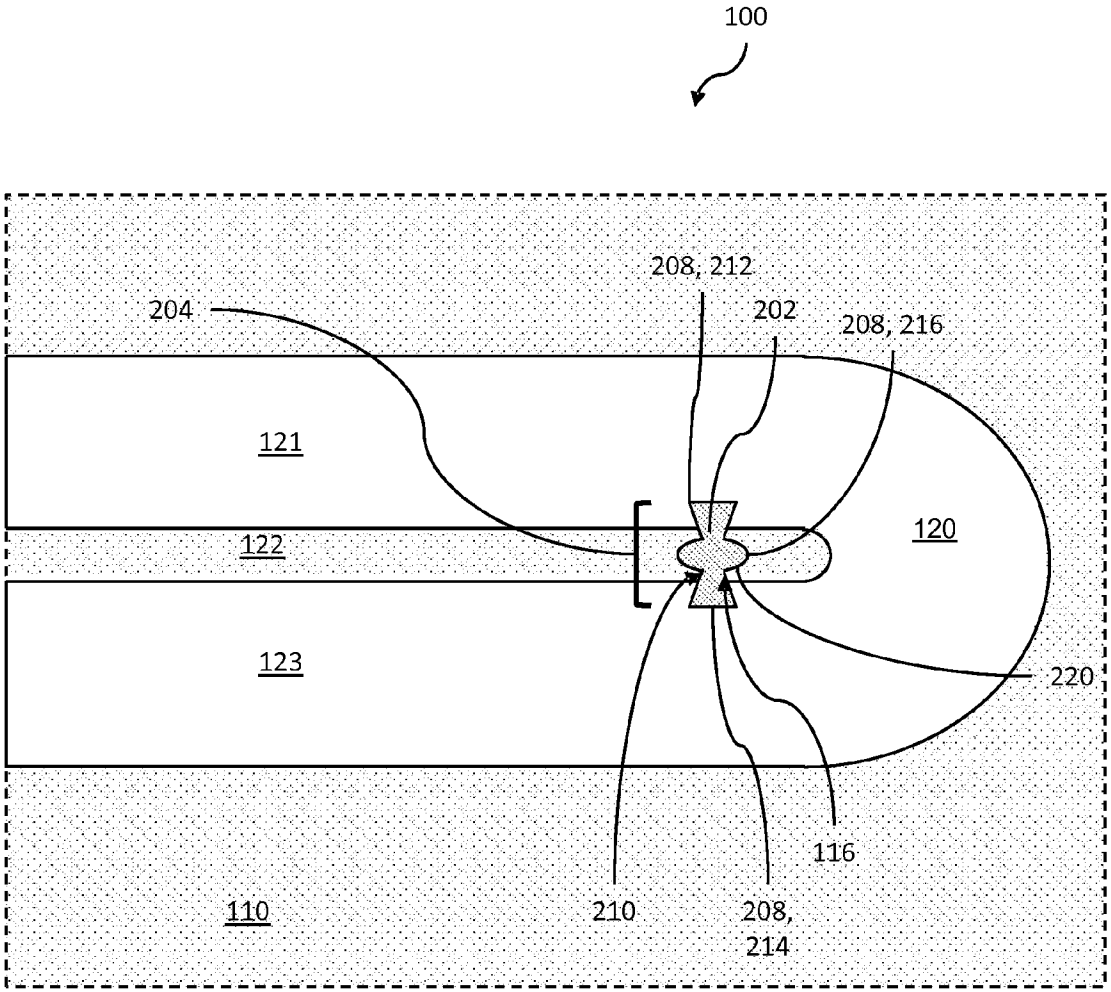

In another embodiment, shown in FIG. 7, tie member 202 may have a first cross sectional diameter 208 at each of a first end 212, a second end 214, and a point 216 approximately midway along axial length 204 of tie member 202. Tie member 202 may further include a second, smaller cross sectional diameter 210 at each of a point between the first end 212 and the point 216 approximately midway along the axial length 204 of the tie member 202, and a point between the second end 214 and the point 216 approximately midway along the axial length 204 of the tie member 202. As in previous embodiments, the first cross sectional diameter 208 is defined as being greater than the second cross sectional diameter 210, and further as being greater than the diameter of holes 116. In the embodiment shown in FIG. 7, a first leg 121 and a second leg 123 of cooling passageway 120 are disposed substantially alongside one another, with a metal ligament 122 disposed therebetween. First leg 121 and second leg 123 each have a hole 116, arranged such that the holes 116 in the respective legs are aligned, and core tie 200 passes through the hole 116 in each of first and second legs 121, 123. Core tie 200 is locked in place by the relationship between the first cross sectional diameter 208 at each of first and second ends 212, 214, and approximate midpoint 216 and the diameter of holes 116 in a fashion similar to that described above.

In embodiments such as the one shown in FIG. 7, tie member 202 may have a hybrid shape combining the conical and bead elements of FIGS. 3 and 6 respectively, although other shapes are both possible and considered part of the present disclosure. Additionally, tie member may have an asymmetrical shape such that first end 212 and second end 214 have different shapes. Accordingly, any of the first and second end 212, 214 shapes of tie members 202 shown in FIGS. 3-7 may be combined with one another in a single tie member 202.

In each of the foregoing embodiments, core tie 200 may be inserted into core(s) 112 during manufacturing of the cores as described above (FIGS. 1-2), and may be left in place rather than being removed when core(s) 112 are leached out. Core ties 200 may remain in place in component 100 when the component is used in the field. Since core ties 200 may not be removed from holes 116, additional processing steps for removing core ties 200 and sealing the resulting holes 116 are not required. As a result, there is increased flexibility in the quantity and positioning of core ties 200 in component 100, which furthers the creation of more efficient and castable component designs.

It is noted that the shapes depicted in FIGS. 3-7 are merely illustrative of the possible variations in cross sectional diameter. It is noted that in the various embodiments, first cross sectional diameter at, e.g., first end 212 may be slightly different from a first cross sectional diameter 208 at a second end 214, so long as both first end 212 and second end 214 have diameters which are greater than that of both any region defined as having second cross sectional diameter 210, and hole 116. Similarly, second cross sectional diameter 210 at, e.g., first end 212 may be slightly different from a second cross sectional diameter 210 at a second end 214, so long as both first end 212 and second end 214 have diameters which are smaller than that of any region defined as having first cross sectional diameter 208.

Figure 8:
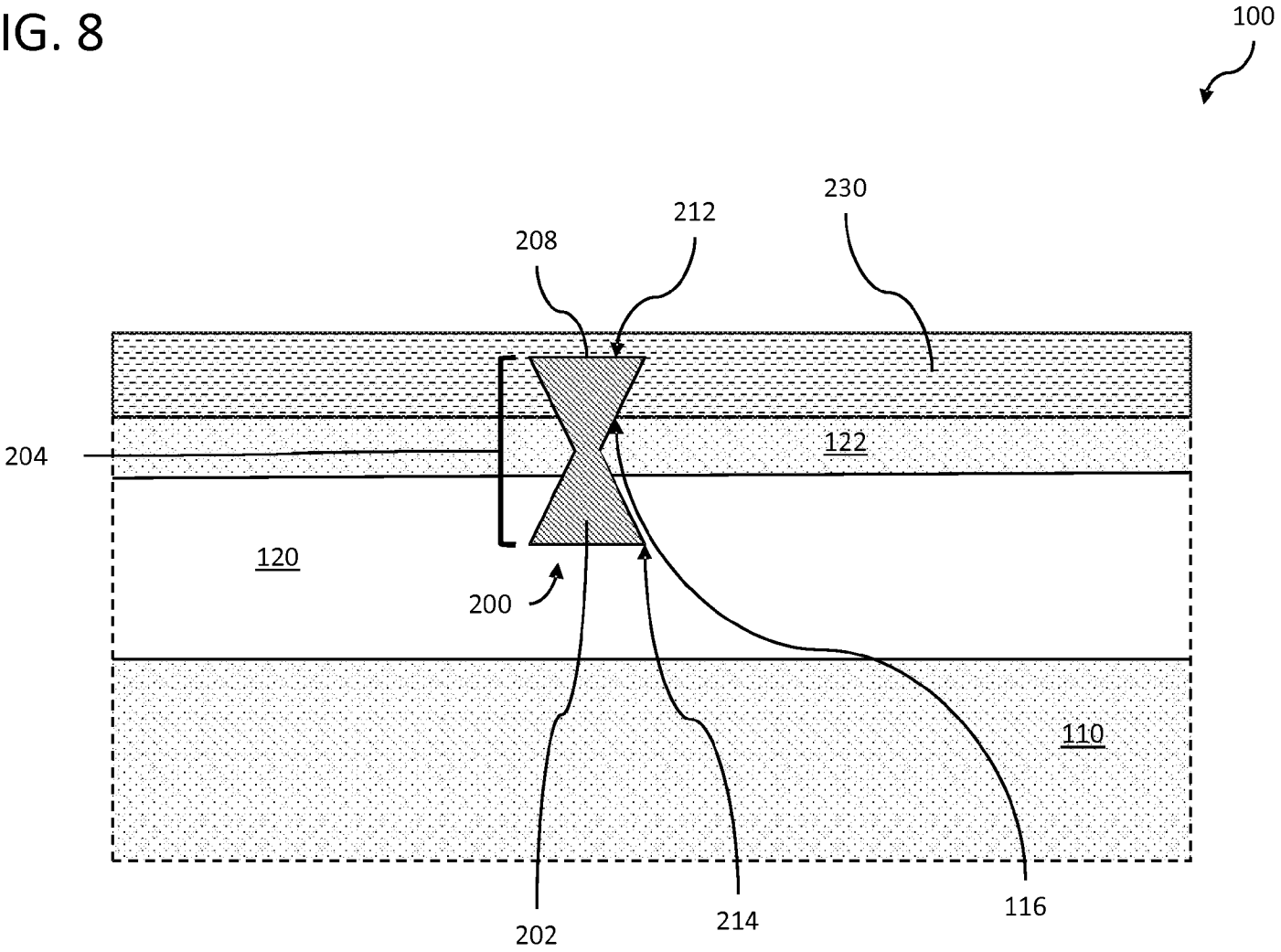
FIG. 8 shows a side cross sectional view of a portion of a component during fabrication according to embodiments of the disclosure.
Figure 9:
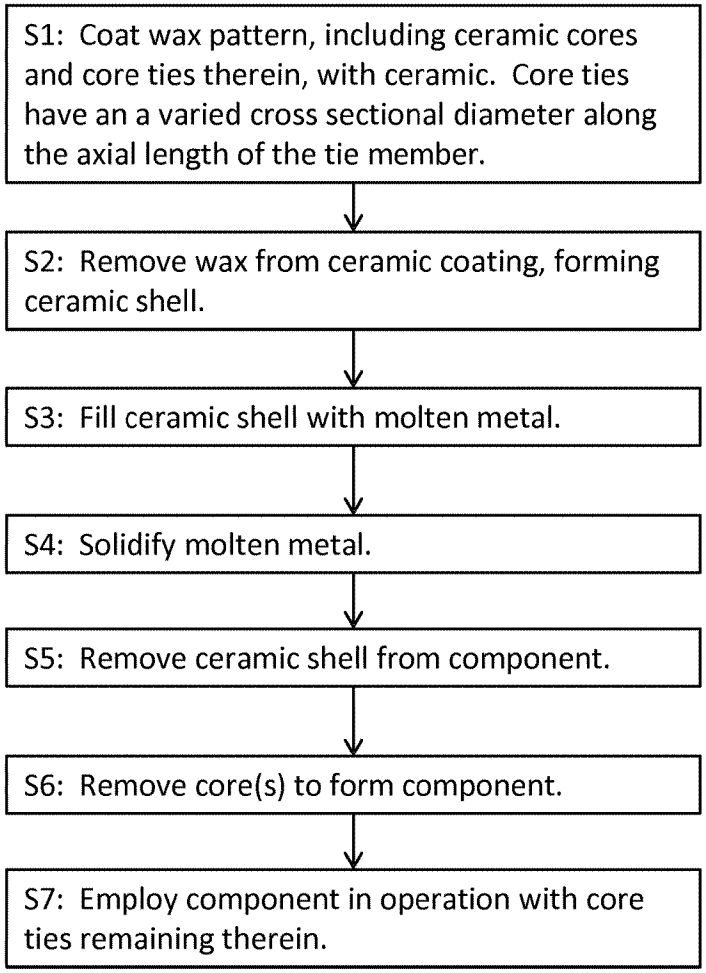
FIG. 9 shows a flow chart depicting a method of casting a hot gas path component for a turbomachine according to an embodiment of the disclosure.

Further, each of the variations in cross sectional diameter and shape described above relative to FIGS. 3-7 may be used in connection with the embodiment of FIG. 8. In the embodiment of FIG. 8, instead of spanning between first leg 121 and second leg 123 of cooling passageway 120 as in FIGS. 3-7, core tie 200 extends from cooling passageway 120 to or into an inner surface of the mold or shell 230. In such an embodiment, during fabrication of component 100, core tie 200 may protrude through the wax pattern. When a ceramic coating is placed over the wax pattern to form shell 230, core tie 200 may be locked into place by shell 230. Once the metal is poured into the shell 230 to form body 110 and the shell 230 is removed, core tie 200 may be left in place. Core tie 200 may protrude slightly from an outer surface of body 110 or may be filed or trimmed to sit flush with the outer surface of body 110.

With respect to each of the above described embodiments in FIGS. 3-8, additional features may also be provided to aid in securing core tie 200 within component 100. For example, each of first end 212 and second end 214 may include a loop or other feature or change in cross sectional diameter to further aid in securing core tie 200. It is noted that the shapes and features of core tie 200 as described above are intended to be merely illustrative, and non-limiting in nature.

With reference to FIG. 9, a method of casting a hot gas path component for a turbomachine is described. As shown in FIG. 9, in a first step S1, a wax pattern for the component is coated with a ceramic material. The wax pattern may include a ceramic core disposed within the pattern, the core being held in place by at least one core tie. The core tie may couple the core to another core, a leg to another leg of the same core, or may extend outward from the core. The core tie may include a tie member having an axial length, and a cross sectional diameter which varies along the axial length of the tie member.

In step S2, the wax is removed from the ceramic coating, forming a ceramic shell. The cores continue to be held within the ceramic shell by the core ties. In step S3, the ceramic shell is filled with molten metal. In step S4, after the molten metal solidifies, forming the component body. In step S5, the ceramic shell is removed, for example, by beating the component body with a pneumatic hammer, sawing, or other methods as will be apparent to one of skill in the art. In step S6, core(s) are removed, for example, by a leaching process. The component is thus formed, with core ties remaining therein. The core ties remain positively locked in place due to the varied cross sectional diameters along the axial length thereof, and in an optional step S7, may remain in place for up to the duration of the life of the component. In some embodiments in which core tie 200 protrudes from an outer surface of the body of the component, the core tie may be trimmed or filed down such that it is flush with an outer surface of the metal component.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 25 mm, or, more specifically, about 5 mm to about 20 mm," is inclusive of the endpoints and all intermediate values of the ranges of "about 5 mm to about 25 mm," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A component comprising:

a body;

a first cooling passageway disposed within the body, the first cooling passageway including a first hole therein; and a core tie disposed in the first hole, such that the core tie occludes the first hole, the core tie comprising:

a tie member having an axial length, and a substantially rectangular cross sectional area which varies along the axial length of the tie member, wherein a variation in the cross sectional area of the tie member positively secures a position of the core tie relative to the first hole, wherein the tie member includes:

a first cross sectional area at each of a first end, a second end, and a point approximately midway along the axial length of the tie member, and a second cross sectional area at each of a point between the first end and the point approximately midway along the axial length of the tie member, and a point between the second end and the point approximately midway along the axial length of the tie member, wherein the first cross sectional area is greater than the second cross sectional area, and wherein the first cross sectional area is greater than a diameter of the first hole.

2. The component of claim 1, wherein the core tie further comprises a ceramic, alumina, or quartz.

3. The component of claim 1, wherein the core tie further comprises a metal.

4. The component of claim 1, wherein the component is a hot gas path component of a turbo-machine.

5. The component of claim 4, wherein the hot gas path component includes a nozzle or a shroud.

6. The component of claim 4, wherein the hot gas path component includes a bucket.

7. The component of claim 1, further comprising:

a second cooling passageway having a second hole therein wherein the second hole is aligned with the first hole such that core tie passes through both of the first hole and the second hole.

8. The component of claim 1, wherein a geometry of the core tie, including a variation in the cross sectional area of the tie member, positively locks the core tie in place.

9. A component comprising:

a body;

a first cooling passageway disposed within the body, the first cooling passageway including a first hole therein; and a core tie disposed in the first hole, such that the core tie occludes the first hole, the core tie comprising:

a tie member having an axial length; and a cross sectional area which varies along the axial length of the tie member, wherein a variation in the cross sectional area of the tie member positively secures a position of the core tie relative to the first hole, and the tie member includes:

a first cross sectional area at each of a first end, a second end, and a point approximately midway along the axial length of the tie member, and a second cross sectional area at each of a point between the first end and the point approximately midway along the axial length of the tie member, and a point between the second end and the point approximately midway along the axial length of the tie member, wherein the first cross sectional area is greater than the second cross sectional area, and wherein the first cross sectional area is greater than an area of the first hole.

10. The component of claim 9, wherein the cross sectional area of the tie member is substantially circular, substantially ovoid, or substantially rectangular.

11. The component of claim 9, wherein the core tie further comprises a ceramic, alumina, or quartz.

12. The component of claim 9, wherein the core tie further comprises a metal.

13. The component of claim 9, wherein the component is a hot gas path component of a turbo-machine.

14. The component of claim 13, wherein the hot gas path component includes a nozzle or a shroud.

15. The component of claim 13, wherein the hot gas path component includes a bucket.

16. The component of claim 9, further comprising:

a second cooling passageway having a second hole therein wherein the second hole is aligned with the first hole such that core tie passes through both of the first hole and the second hole.

17. The component of claim 9, wherein a geometry of the core tie, including a variation in the cross sectional area of the tie member positively locks the core tie in place.

18. A component comprising:

a body;

a first cooling passageway disposed within the body, the first cooling passageway including a first hole therein; and a core tie disposed in the first hole, such that the core tie occludes the first hole, the core tie comprising:

a tie member having an axial length, and a cross sectional area which varies along the axial length of the tie member, wherein a variation in the cross sectional area of the tie member positively secures a position of the core tie relative to the first hole, wherein the tie member includes, in order of axial position, a first, second, third, fourth, and fifth cross sectional area along the axial length of the tie member, and each of the second and fourth cross sectional areas is smaller than each of the first, third, and fifth cross sectional areas, and wherein the first and fifth cross sectional areas are each greater than a diameter of the first hole.

19. The component of claim 18, wherein the cross sectional area of the tie member is substantially circular, substantially ovoid, or substantially rectangular.

20. The component of claim 18, wherein the core tie further comprises a ceramic, alumina, quartz, or a metal.

* * * * *